US007766759B2

(12) United States Patent
Henwood et al.

(10) Patent No.: US 7,766,759 B2
(45) Date of Patent: Aug. 3, 2010

(54) PUTTING TRAINING DEVICE

(75) Inventors: Richard Daniel Henwood, Arroyo Grande, CA (US); William Henwood, Norcross, GA (US)

(73) Assignee: Solid Golf LLC, Norcross, GA (US)

( * ) Notice: Subject to any disclaimer, the term of this patent is extended or adjusted under 35 U.S.C. 154(b) by 0 days.

(21) Appl. No.: 11/897,211

(22) Filed: Aug. 29, 2007

(65) Prior Publication Data

US 2008/0167136 A1 Jul. 10, 2008

(51) Int. Cl.
*A63B 69/36* (2006.01)

(52) U.S. Cl. ..... 473/226; 473/220; 473/251

(58) Field of Classification Search ..... 473/219–226, 473/231–234, 238, 240, 409; 356/138, 399, 356/614

See application file for complete search history.

(56) References Cited

U.S. PATENT DOCUMENTS 2,822,614 A * 2/1958 Susinno ..... 33/263
3,118,678 A * 1/1964 Rohr ..... 473/240
4,116,448 A * 9/1978 Crowe, Jr. ..... 473/240
4,884,813 A * 12/1989 Cates ..... 473/268
4,997,189 A * 3/1991 Perkins ..... 473/221
5,330,188 A * 7/1994 Reimers ..... 473/151
5,692,966 A * 12/1997 Wash ..... 473/221
6,375,579 B1 * 4/2002 Hart ..... 473/131
6,461,248 B1 * 10/2002 Gross ..... 473/220
7,128,657 B1 * 10/2006 McCarthy et al. ..... 473/220
7,252,596 B1 * 8/2007 Matousek ..... 473/226
7,286,230 B1 * 10/2007 Salmon ..... 356/399

* cited by examiner

*Primary Examiner*—Nini Legesse
(74) *Attorney, Agent, or Firm*—Fay Sharpe LLP

(57) ABSTRACT

A putting training device comprising a putter module which is selectively attachable and detachable to a putter and a target module. The putter module includes at least one indicia viewable when a users head is substantially vertically above the module. The putter module further includes a signaling element and the target module including a receiving element, and an indicating element. In use, the putter is directed towards the target module. A golf ball is struck in the direction of the target module and the indicating element alerts the user of impact condition.

6 Claims, 9 Drawing Sheets

PUTTING TRAINING DEVICE

BACKGROUND

This device pertains to the field of golf in general and specifically to the art of putting. The art of putting consists of three major factors; posture and alignment at contact with the ball, tempo of the putting stroke and striking the ball with the club face perpendicular to target. Many attempts have been made in the past to devise a product that could alert the user in real time to the condition of these factors while they are practicing the art of putting. Some prior art has been successful by addressing only one or two of the factors, by incorporating the sensing means into a custom putter which is not legal for USGA tournament play, or by large expensive stationary devices.

A putting training device comprising a Putter Module which is selectively attachable and detachable to a putter and a Target Module. The putter module includes at least one indicia viewable when a users head is substantially vertically above the module. The Putter Module further including a signaling element and the target module including a receiving element, and an indicating element.

DETAILED DESCRIPTION

Figure 1A:
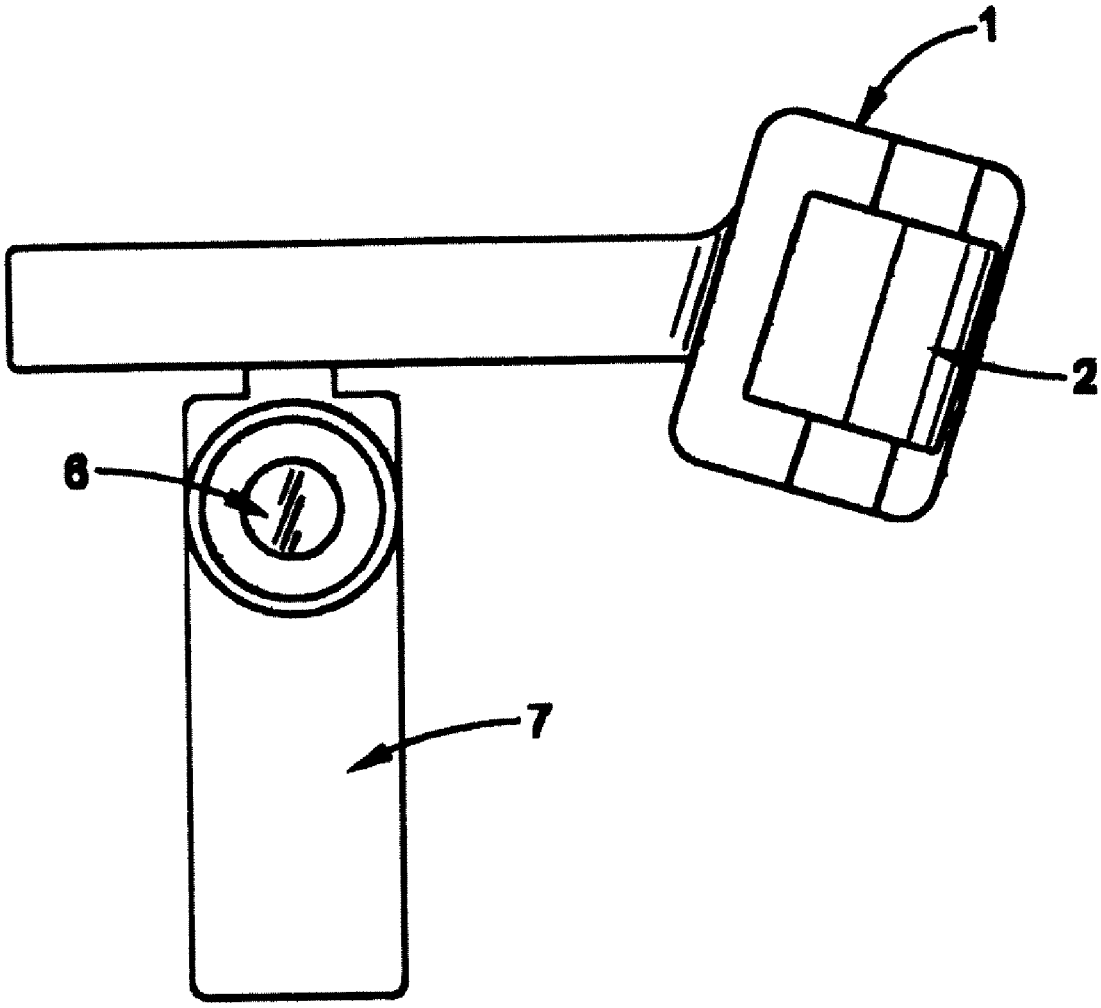
FIG. 1*a* is a front elevation view of the putter module.
Figure 1B:
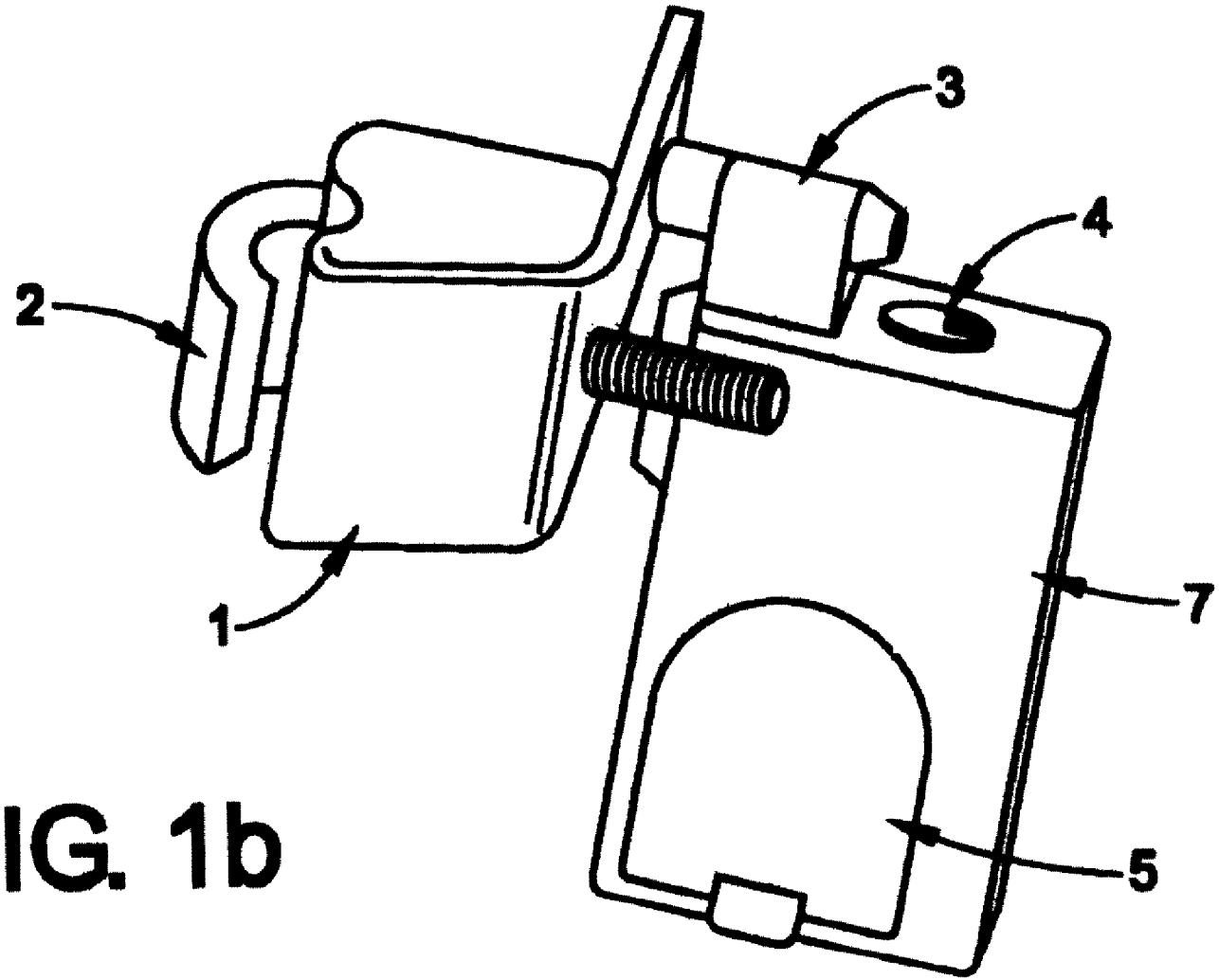
FIG. 1*b* is a side elevation view of the putter module.
Figure 1C:
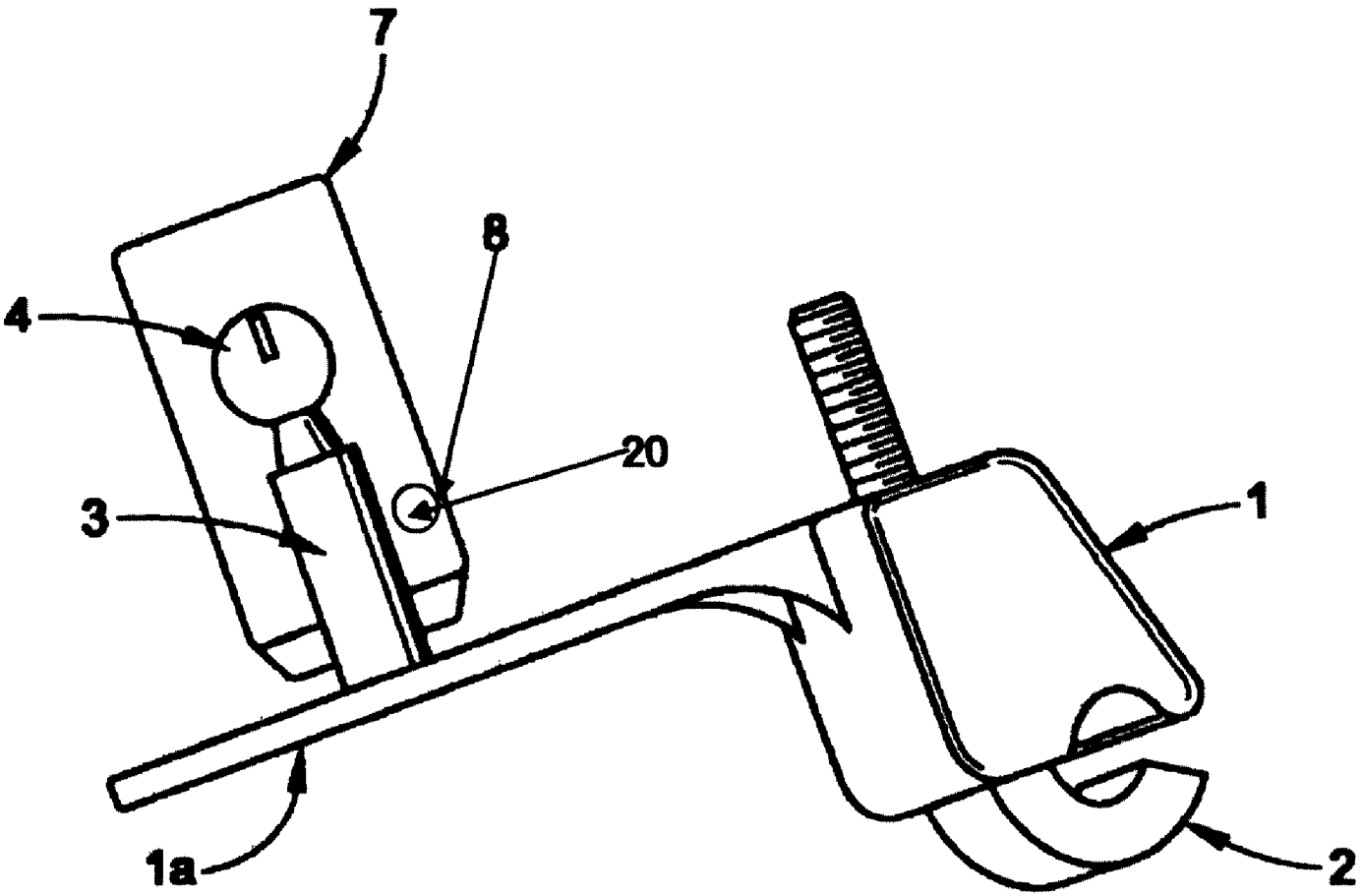
FIG. 1*c* is a rear elevation view of the putter module.
Figure 2:
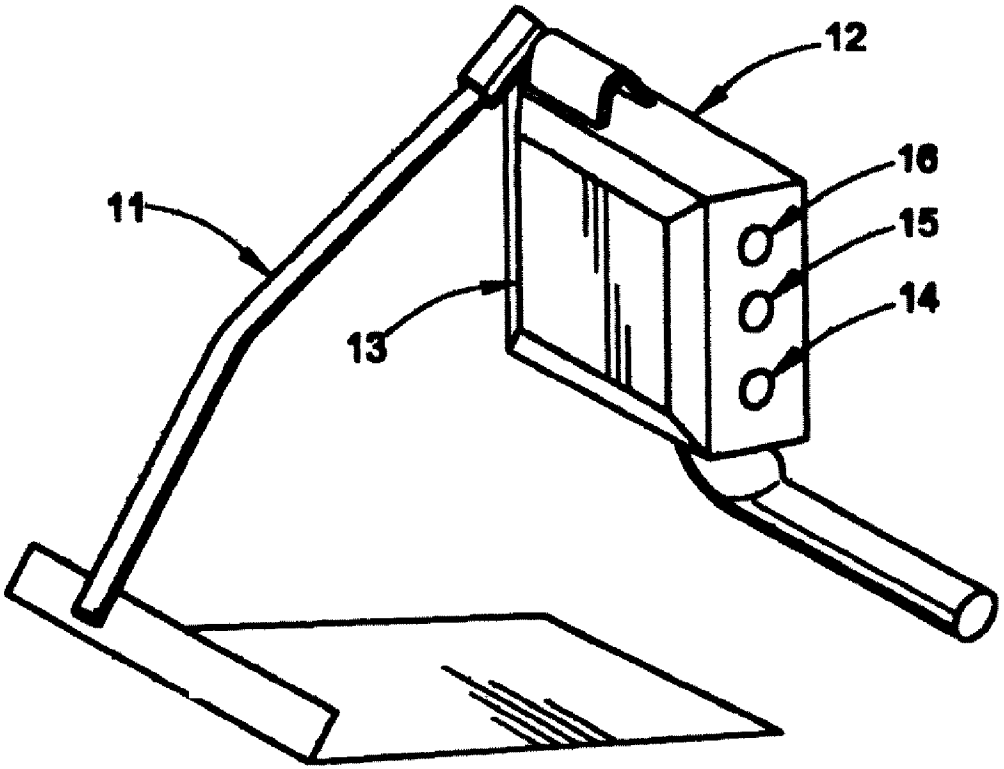
FIG. 2 is a front perimeter view of the target module.
Figure 4:
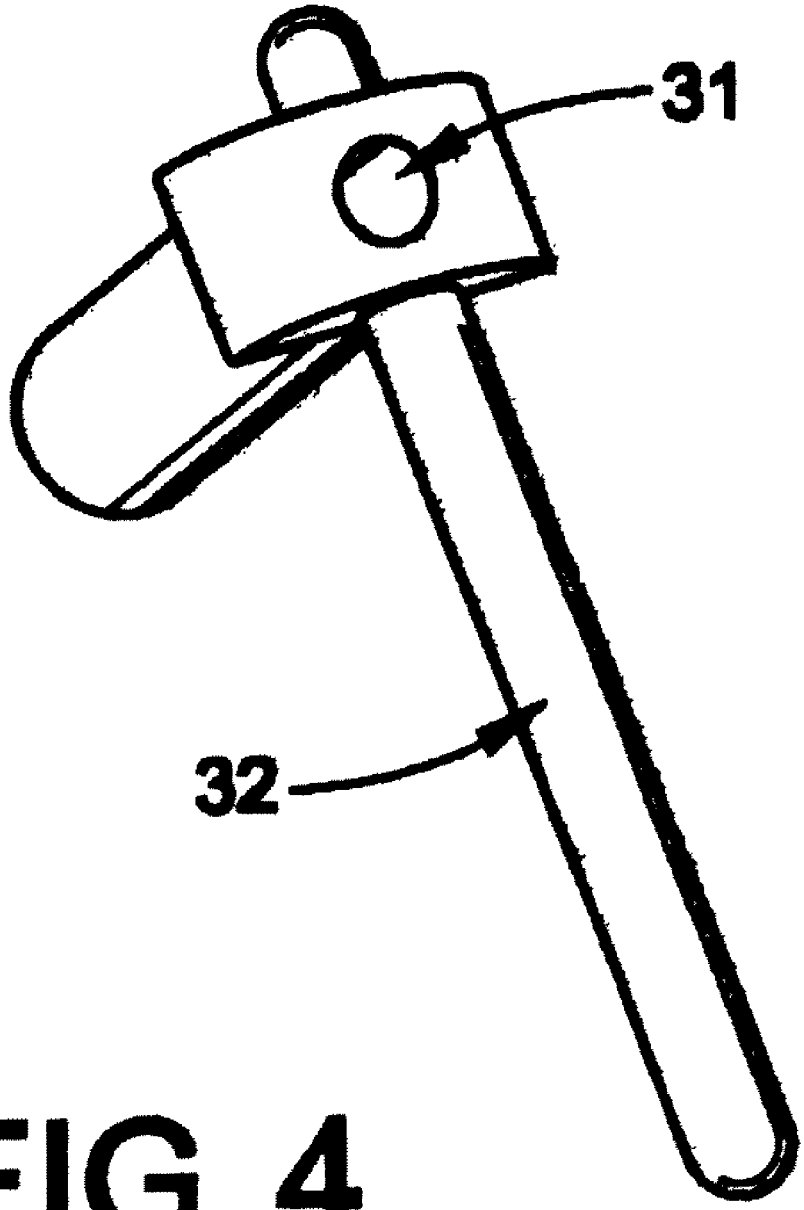
FIG. 4 is a perspective view of the shutter.

The putting training device described herein, addresses three major factors, The device is small, portable, can be affixed to any right handed putter 70 and will be affordable to most golfers. The benefit of this is that the golfer can practice putting (at home, at the office or on a putting green) with a putter they are accustom to, remove the training device and go play with the same putter. The device provides the user with instant feedback as to the temp of their putting stroke, the squareness to the target at impact with the ball 73 and posture and alignment at address. The device consists of two modules, the Putter Module (FIGS. 1*a*, 1*b*, and 1*c*) and the Target Module (FIG. 2). Once the Putter Module (FIG. 1*a*, 1*b*, 1*c*) is affixed to the shaft user's putter 70 and turned on, the user will notice a small green light (indicia) 8 that appears on the top of the Putter Module. The green light acts as a guide for the user and is provided for by a signaling element 20. Preferably, the signaling element 20 comprises an infrared light source. It is also preferable if the light is generated by a light emitting diode. This light has a limited viewing angle and the users head must be directly over it to be seen. This is the posture most experts in the field feel is required at address to the ball to achieve proper alignment to the target. Next, the user will aim the face of their putter towards the target. When the Putter Module (FIGS. 1*a*, 1*b*, 1*c*) aligns with the Target Module (FIG. 2), the signaling element 20 connects with a receiving element 16 on the Target Module and an amber light 14 will appear on the target. Preferably, the receiving element 16 is an infrared receiver. Next, the user will take a few practice strokes, observing the green light 8 on the Putter Module (FIGS. 1*a*, 1*b*, 1*c*). A pendulum element 32, intermediate of the green light 8 and the outlet for the light from the housing, will physically occlude viewability of the light when a swing is off track or uneven in velocity. Therefore, if the green light (LED) 8 is constant, the users' stroke is smooth and pendulum like. If the green light is intermittent, the stroke is jerky, indicating over acceleration or deceleration. The aperture 31 of green light 8 is tangent to the shutter(FIG. 4), which is located on the Putter Module. When the user is satisfied that their stroke is smooth, they will address the ball 73. Again, a user will check their posture by observing the green light (LED) 8 on top of the Putter Module (FIGS. 1*a*, 1*b*, 1*c*) and check the squareness of the face of the putter to the target by observing the amber light 14 on the Target Module (FIG. 2). Next, a user will stroke the putt towards the target. At the moment of impact, the amber light 14 on the target will go out. If the putter was square to the target at impact, a green light (LED) 15 will appear on the Target Module (FIG. 2). If the putter face was not square to the target, no light will appear. After a two (2) second delay, the Target Module (FIG. 2) will again be ready to recognize an alignment signal from the Putter Module (FIG. 1*a*, 1*b*, 1*c*).

Figure 5:
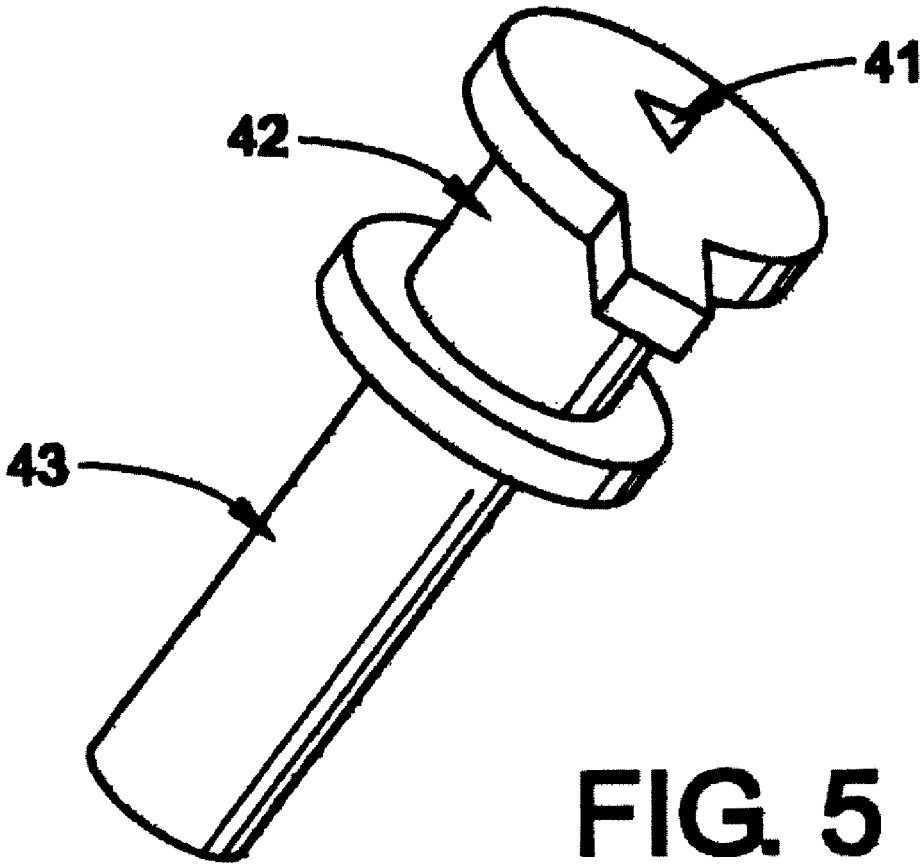
FIG. 5 is a perspective view of the aperture.
Figure 6:
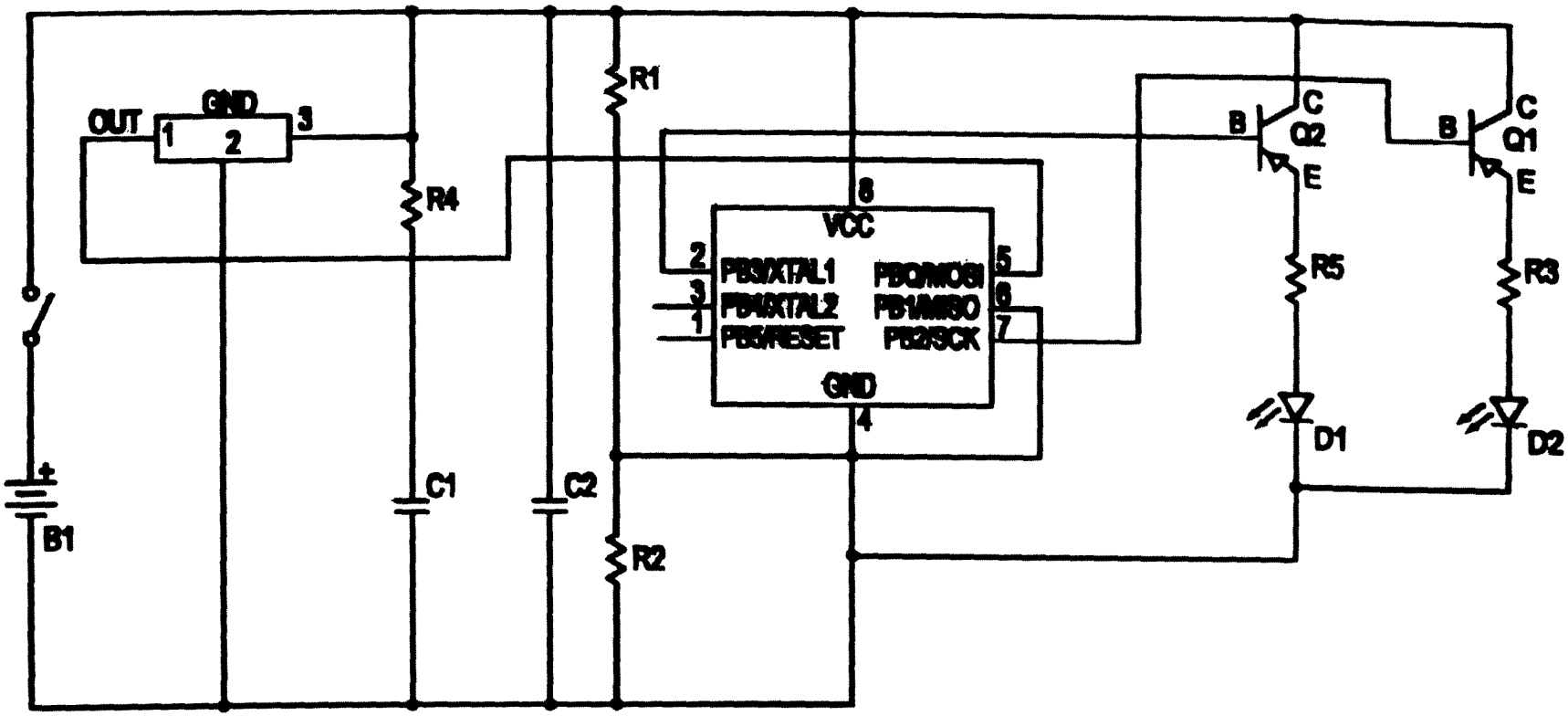
FIG. 6 is a schematic diagram of the target module circuitry.
Figure 7:
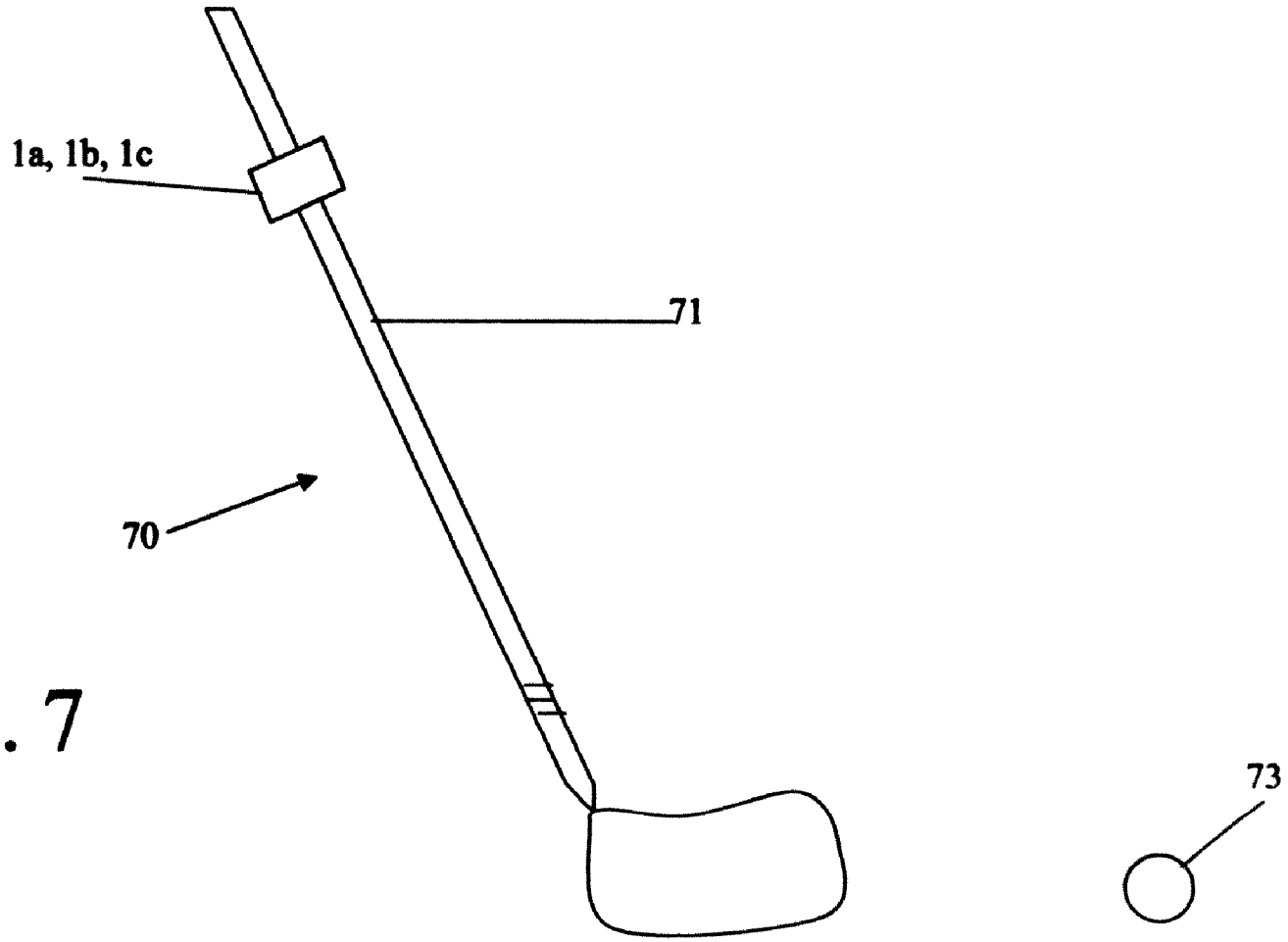
FIG. 7 is a perspective view of a putter and a ball.

The Putter Module (FIGS. 1*a*, 1*b*, 1*c*) preferably consists of: a mounting bracket 1, which attaches the Putter Module to the shaft 71 of the putter 70, (FIG.7). Clamp 2, holds the mounting bracket 1 to the putter 70. The pivot 3, which allows the Putter Module to position itself perpendicular to the ground regardless of the lie angle of the putter. The aperture control 4, varies the width of the beam projected by the Putter Module (FIG. 1*a*) thru the lens 6. A user may use the aperture control 4 to adjust the amount of light emitted through the aperture 31, (FIG. 5). The aperture 31, (FIG. 5) includes a cam 43, bearing surface 42, and indicador 41. Housing 7, contains the printed circuit board (described in schematic drawing FIG. 3) and the battery door which allows for replacement of the battery. The Target Module (FIG. 2) consists of a stand 11 and a housing 12. Within the housing 12 is a printed circuit board, described by the schematic drawing (FIG. 6). Preferably, the Target Module further includes a first and second light element of different colors. The printed circuit board on the front face of the target preferably comprises an ambar LED 14, a green LED 15 and an infrared receiver 16. The target (FIG. 2) also has a target housing door 13 for easy replacement of the batteries. Those versed in the art will recognize the functions described in the schematic circuits shown in FIG.3 and FIG.6.

Figure 3:
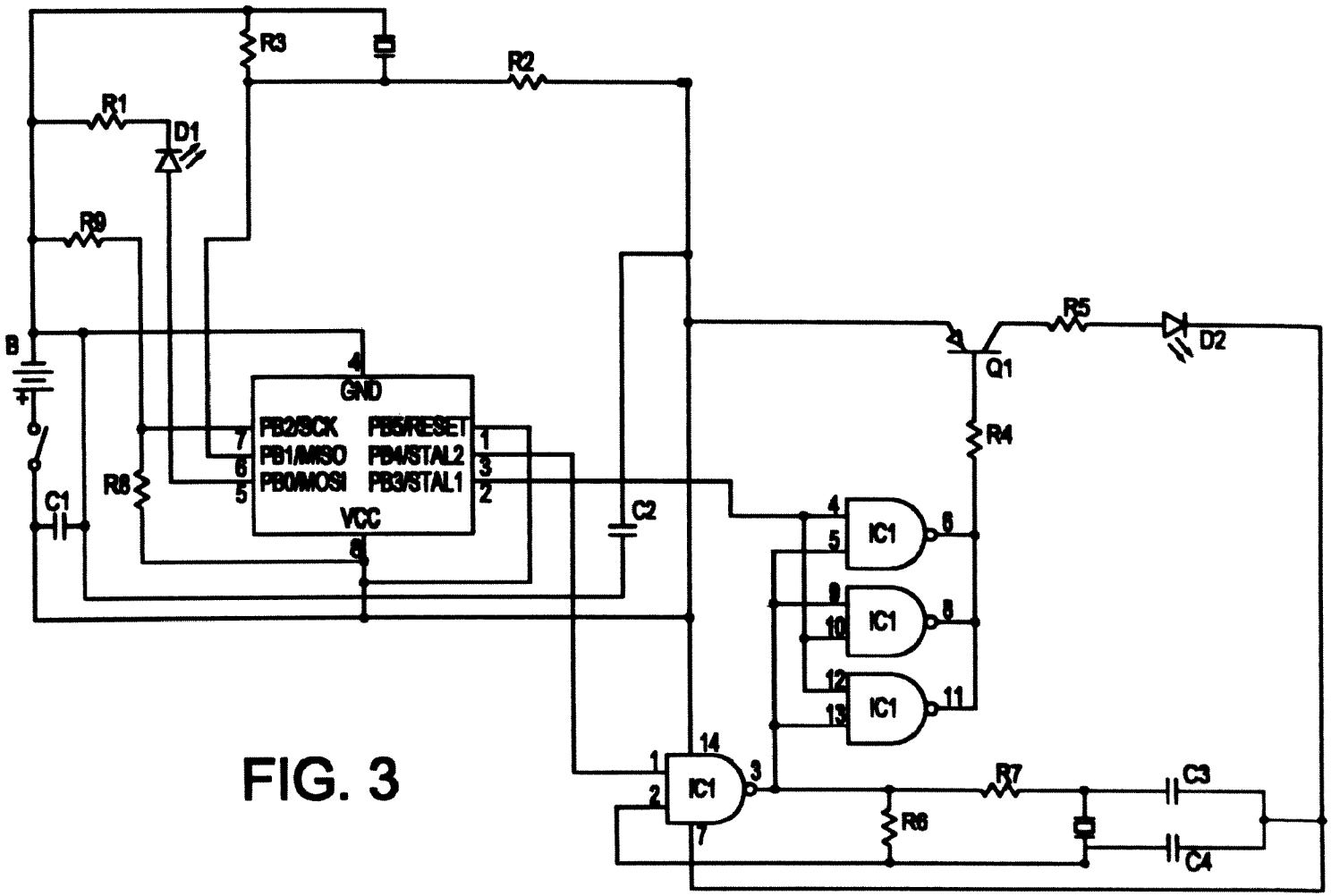
FIG. 3 is a schematic diagram of the putter module circuitry.

FIG. 3 one exemplary embodiment of the Putter Module, describes the following functions:

C1—capacitor—conditions the power supply provided by the battery B1 thru switch S1.

R8&9—resistors—provide a reference voltage to set the low battery indicator.

R1&D1—Green LED & current limiting resistor, provide the posture alignment indicator.

R2&R3—resistors—provide a reference voltage to set the sensitivity of X1.

X1—Piezo element—converts the mechanical energy of the shock of impact with the ball to an electrical signal.

uC1—Microcontroller—signals a low battery condition by blinking D1, senses the impact of the ball via X1 and times the impact signal generated by 1C1.

1C1—Quad nand gate—generates the alignment signal and impact signal impressed on the carrier signal sent by D2.

X2—Resonator—generates the 455 Khz. carrier signal.

Q1—Transistor—drives D2.

D2—Inferred emitting diode—sends the signal to the target.

FIG. 6, one embodiment of the Target Module describes the following:

PT1—Inferred detector—receives the signal from the Putter Module.

R1&R2—Resistors—provide a voltage reference for the low battery function.

U1—Microcontroller—interprets the signal received from the Putter Module via PT1 and determines which LED to illuminate (amber 14 and Green 15).

Q1&Q2—Transistors—which drive their respective LED's.

D1&D2—LED's display the alignment signal and the proper impact signal.

We claim:

1. A putting training device comprising:

a putter module which is selectively attachable and detachable to a putter, and a target module; wherein said putter module includes at least one indicia viewable when a users head is substantially vertically above the module, said indicia comprising a light generated by a light emitting diode and including a pendulum element intermediate to said light emitting diode and an outlet for said light from a housing, said pendulum element physically occluding viewability when a putting swing is off track or uneven in velocity, said putter module further including a signaling element; and, wherein said target module includes a receiving element and an indicating element.

2. The device of claim 1 wherein the signaling element comprises an infrared light source.

3. The device of claim 2 wherein the receiving element comprises an infrared receiver.

4. The device of claim 1 wherein an aperture allows adjustment of a beam width generated by said signaling element.

5. The device of claim 1 wherein the said putter module is attachable to a shaft of said putter via a mounting bracket and clamp.

6. The device of claim 5 wherein the said putter module includes a pivot joint intermediate to said mounting bracket and a housing containing said viewable indicia and said signaling element.

* * * * *